US006409423B1

(12) United States Patent
Li

(10) Patent No.: US 6,409,423 B1
(45) Date of Patent: Jun. 25, 2002

(54) PRESTRESSED PAVEMENT SYSTEM

(76) Inventor: Ran Li, c/o Yaxin Li, 710 Fontana Pl., Mundelein, IL (US) 60060

( * ) Notice: Subject to any disclaimer, the term of this patent is extended or adjusted under 35 U.S.C. 154(b) by 0 days.

(21) Appl. No.: 08/616,086

(22) Filed: Mar. 15, 1996

Related U.S. Application Data

(63) Continuation-in-part of application No. 08/235,338, filed on Apr. 29, 1994, now abandoned.

(51) Int. Cl.[7] ..... E01C 11/10; E04C 5/08

(52) U.S. Cl. ..... 404/49; 404/17; 404/72; 52/223.6; 52/223.7; 264/228; 264/229

(58) Field of Search ..... 404/27, 30, 34, 404/43–45, 31, 67, 70, 72, 75, 49, 17; 52/223.1, 223.2, 223.6, 223.7, 223.14; 264/228, 229; 60/477, 478; 138/26, 30

(56) References Cited

U.S. PATENT DOCUMENTS 2,251,672 A * 8/1941 Friberg
2,280,455 A * 4/1942 Seuberling
2,655,846 A * 10/1953 Freyssinet
2,833,186 A * 5/1958 Dobell
2,852,991 A * 9/1958 Dobell et al. ..... 264/228 X
2,910,921 A * 11/1959 Freyssinet
3,022,713 A * 2/1962 Friberg
3,089,215 A * 5/1963 Stubbs ..... 264/228 X
3,420,146 A * 1/1969 McPherson ..... 60/477 X
3,437,017 A * 4/1969 Walz et al.
3,577,896 A * 5/1971 Finsterwalder et al. ..... 404/74
3,959,970 A * 6/1976 Bos et al. ..... 60/477
4,052,852 A * 10/1977 Hart ..... 138/30 X
4,245,923 A 1/1981 Rieve ..... 404/70
4,653,956 A 3/1987 Lang
4,657,430 A * 4/1987 Marionneaux ..... 404/74
4,819,697 A * 4/1989 Randa et al. ..... 138/30
5,141,358 A * 8/1992 Burke et al. ..... 404/49
5,342,568 A * 8/1994 Yokota ..... 52/223.6 X

OTHER PUBLICATIONS

Highway Research Board Special Report 78, "Prestressed Concrete Pavements", National Research Council, Washington, D.C., 1963.*

* cited by examiner

*Primary Examiner*—Gary S. Hartmann

(57) ABSTRACT

A prestressed pavement has apparatus to prestress the slabs, has slab abutments to resist the prestress force, has short-life friction-reducing medium to prevent the slab early cracking, has restraints to prevent the slab buckling, and has accumulators to control the prestress. The pavement does not need longitudinal tensile material, and can be built by continuous and one-time concrete casting. The prestressing is simple, fast, and may be delayed or made by stages. The techniques can be used to convert existing non-prestressed concrete pavements to prestressed pavements.

26 Claims, 13 Drawing Sheets

FIG.11'A
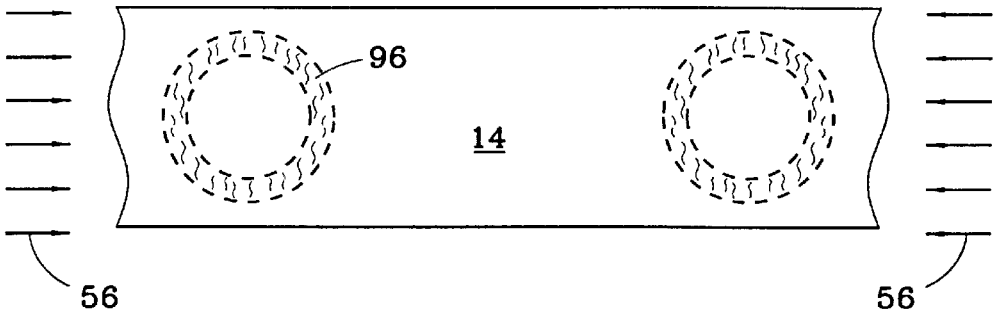
FIG.11'B
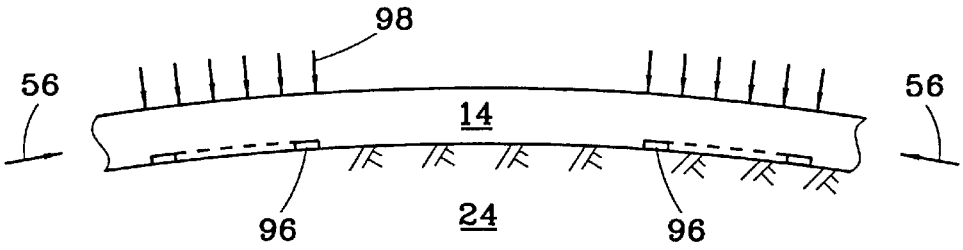

PRESTRESSED PAVEMENT SYSTEM

This application is a Continuation-in-Part of the application Ser. No. 08/235338, filed Apr. 29, 1994, now abandoned. This application claims for a foreign priority from a Chinese patent application Serial No. 95102657.7, filed Mar. 3, 1995.

BACKGROUND

This invention relates in general to highway or airport pavements of concrete.

Portland cement concrete pavements of highways or airports have long service life and high strength, and are used as a main kind of pavements. But they have significant problems. Plain concrete pavements have many joints in the pavement slabs and the joints bring about cracking, edge failure, faulting, uneven, and/or pumping problems. Simply reinforced concrete pavements have less joints but some minute cracks that cannot be prevented by the reinforcement; the cracks bring about edge failure, water invasion, and other cracks. Continuously reinforced concrete pavements can eliminate the joints, but get more minute cracks and cost considerably more.

To solve these problems, prestressed Portland cement concrete pavements (pcp) were and are developed. The longitudinal compressive prestress in pcp slabs can offset the tensile stress due to temperature drop so the transverse joints in the slabs can be reduced or eliminated, offset the tensile stress due to a vehicle load so the slab thickness can be reduced, and close slab cracks caused by various accident reasons so the slab integrity can be kept. Furthermore, because pcp joints are significantly fewer than plain or reinforced concrete pavement joints, pcp do not require their subbases as strong and water-resistant as the subbases of plain or reinforced concrete pavements, pcp service life is longer, and pcp maintenance is less. Therefore, pcp are expected to be more cost-effective than plain or reinforced concrete pavements.

But pcp fail to prevail in road construction, although they appeared many years ago. The reason is that their structures and constructions are complicated and expensive.

Pcp are divided into two categories: pcp with tendons and tendonless pcp. The former may be divided further into pretensioned and post-tensioned pcp. While the pcp with tendons use steel tendons or other tensile materials to provide compressive prestress for the concrete slabs, the tendonless pcp use abutments to provide the prestress.

The pretensioned pcp are built similarly to the one in general pretensioned concrete production. The steel tendons or wires are stretched and anchored to temporary or permanent abutments in situ. The concrete is then cast around the prestressed tendons. After the concrete has gained sufficient strength, the tendons are released from the abutments. The bond between the tendons and concrete prevents the tendons from shortening, which results in the compression in the concrete. On the contrary, in the post-tensioned pcp construction concrete is first cast in place with embedded unbound tendons or bonded hollow ducts. After the concrete has attained sufficient strength, the tendons are stressed and anchored at the ends of the pavement slab. The tendons may be unbonded, being coated with grease, or bonded, being grouted between tendons and ducts. In the tendonless pcp construction, a series of gap-separated slabs is built between permanent abutments. Flat jacks set in the gaps provide compression to the concrete slabs. Then the gaps are filled with concrete and the jacks are removed.

The pcp with tendons cost much in tensile material, and the auxiliaries for and the operations of the material. The tendonless pcp require expensive abutments, and lose more prestress. Both of the pcp with tendons and tendonless pcp involve complicated prestressing operation and second-time concrete casting to fill up gaps that are needed for prestressing.

SUMMARY OF THE INVENTION

The present invention is a low-cost, high-quality pcp. It does not require longitudinal tendons, its construction is simple and fast, and its prestress is controlled in a predetermined range.

This new pcp comprises apparatus embraced in the pavement slabs for longitudinally prestressing the slabs, comprises slab abutments for resisting the compression, comprises restraints connecting the slabs and the pavement sub-base/grade for preventing the slab buckling, and comprises hydraulic accumulators communicating with the apparatus for controlling the prestress level in the pavement service. If desired, the new pcp also comprises prestressing devices and bars for transversely prestressing the slabs. The apparatus, devices, reinforcement in the slab abutments, prestressing bars, and restraints are all pre-installed or pre-built in/on the pavement support base(subbase and/or subgrade). One pass of a conventional slip-form paver completes slab cast and connection of the slabs and the facilities. Prestressing operation is mainly pumping fluid and grout into the apparatus and devices.

The apparatus crossing the pavement slabs comprise slab slit-forming means and slit-expanding means for compressing the pavement slabs. The slit-forming and expanding means comprise hydraulic cylinders and pistons, or sealed thin flexible tubes which expand the slits to provide the slab prestress in the pavement construction, and which contract or expand the slits to regulate the slab prestress in the pavement service.

The slab abutment utilizes be friction and interlock between the abutment slabs and the support base to resist the prestress load. Since the abutment slabs belong to the general pavement slabs and their main cost is included in the pavement slab cost, the abutments are economical. Other man-made or natural objects being near the pavement and having horizontal resistance may be utilized as abutments. If a structure is designed to possess an abutment function as well is its own function, the sum of the structure cost and the pavement cost is less than the sum of the corresponding normal structure cost and an independent pavement cost.

The restraints using mechanism or vacuum are able to restrain upward deflection of any point of the pavement slabs for preventing buckling of the long slabs, but allow the tangential displacement of the slabs for avoiding obstruction of the prestress transmission.

The short-life friction-reducing medium is applied, because the unfavorable functions of the friction are only in a short period. The medium consists of layers of paper and lubricating jelly that are economical.

The accumulators comprise fluid and compressed air for damping a pressure rise in the apparatus due to temperature increase, and compensating for the pressure drop due to temperature decrease, abutment displacement, and/or concrete shrinkage and creep. According to a hydraulic theory, provided there is a sufficient ratio of compressed-air volume to fluid volume differential in the accumulator, the pressure differential in the apparatus, hence the prestress differential in the pavement slabs, can keep in a sufficiently small range.

Although the present pcp mainly relates to longitudinally tendonless pcp, it can be utilized in other kinds of pcp. This new pcp is suitable to pavements of concrete and pavements of other materials having sufficient compressive strengths. Although the new pcp in general relates to highway and airport pavements, obviously it may extend to parking lots, bridge decks, warehouse floors, etc.

Accordingly, an object of the present invention is to provide a prestressed pavement (prestressed Portland cement concrete pavement or other kinds of prestressed pavement) without longitudinal tendons.

Another object of the invention is to provide a prestressed pavement with embedded prestressing apparatus for easily and quickly prestressing.

Yet another object of the invention is to provide a prestressed pavement that is built by one-time concrete casting and a continuously paving machine.

Yet another object of the invention is to provide a prestressed pavement that favors step and/or delayed prestressing.

Still another object of the invention is to provide a prestressed pavement whose prestress can be measured, controlled, regulated, and/or supplemented during its service.

Still another object of the invention is to provide a prestressed pavement whose joints can transfer most all longitudinal force, shear, and moment from one slab to another.

Still another object of the invention is to provide a prestressed pavement on which the later overlay can easily get prestress.

Still another object of the invention is to provide a prestressed pavement whose prestress can be temporarily removed for rehabilitation.

These and other objects of the present invention will become apparent in the DETAILED DESCRIPTION OF THE PREFERRED EMBODIMENT.

BRIEF DESCRIPTION OF THE DRAWINGS

FIGS. 11'A and 11'B are a plan and a longitudinal profile of a pcp with adhesion-vacuum restraints.

DETAILED DESCRIPTION OF THE PREFERRED EMBODIMENT

Figure 1A:
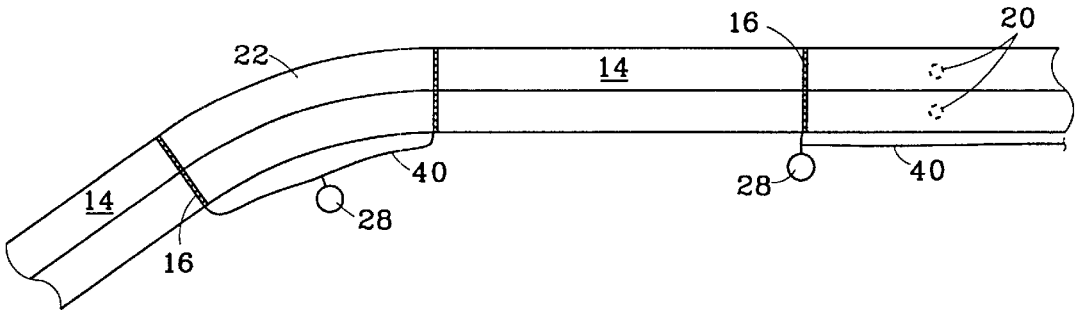
FIGS. 1A and 1B are a plan and a longitudinal profile of a new pcp, respectively.
Figure 1B:
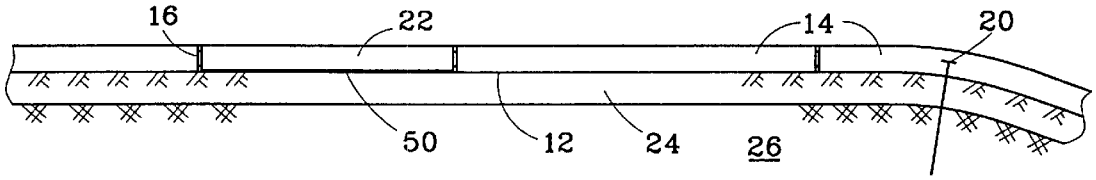

As shown in FIGS. 1A and 1B, a tendonless pcp comprises slabs 14, a subbase 24 on a subgrade 26, prestressing apparatus 16, ducts 40, a slab abutment 22, a layer of friction-reducing material 12, restraints 20, and accumulators 28. The apparatus longitudinally compress the slabs; the abutments resist the compression for the slabs obtaining prestress; the friction-reducing material reduces the slab early cracking and the resistance in prestressing; the restraints restrain upward deflection of the slabs to prevent the slab buckling; the ducts connect the prestressing apparatus and the accumulators; and the accumulators control or regulate the prestress in the slabs.

Longitudinally Prestressing Apparatus

Figure 2A:
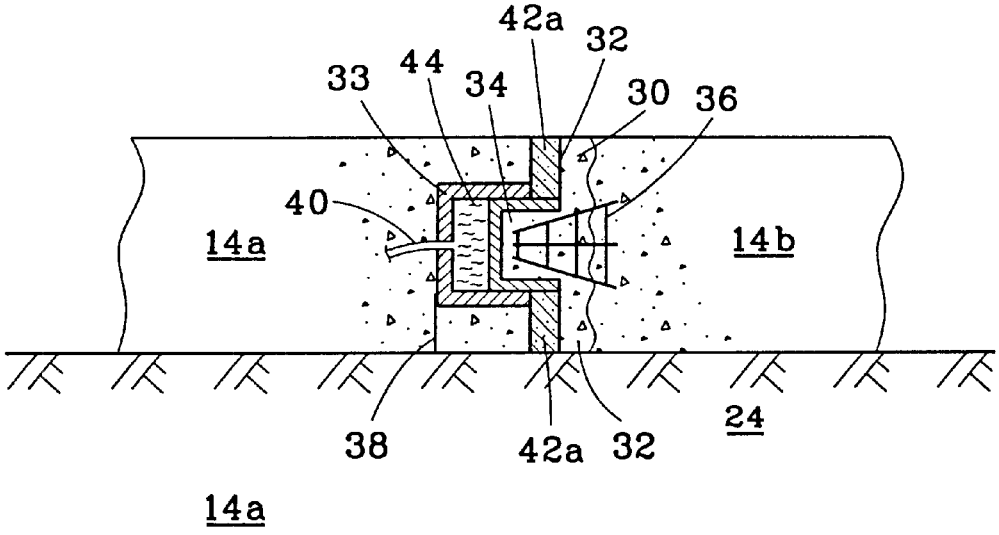
FIGS. 2A and 2B are a side view and a front view of a prestressing apparatus in the pcp in FIG. 1, respectively; and also a longitudinal section and a transverse section of the pcp, respectively.
Figure 2B:
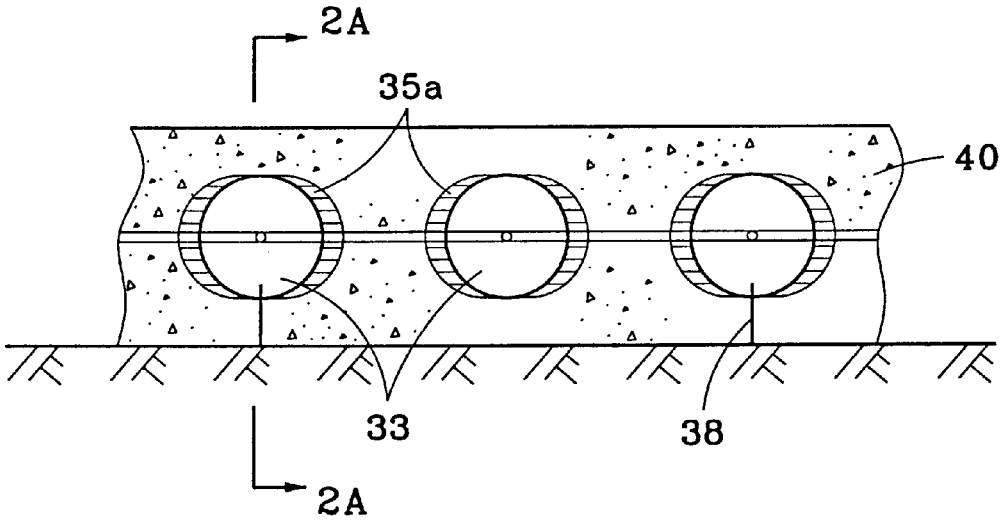
Figure 3A:
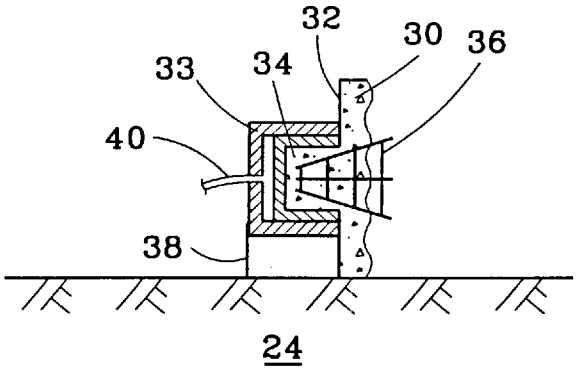
FIGS. 3A and 3B are a side view and a plan of the prestressing apparatus in FIG. 2 before the slabs form, respectively.
Figure 3B:
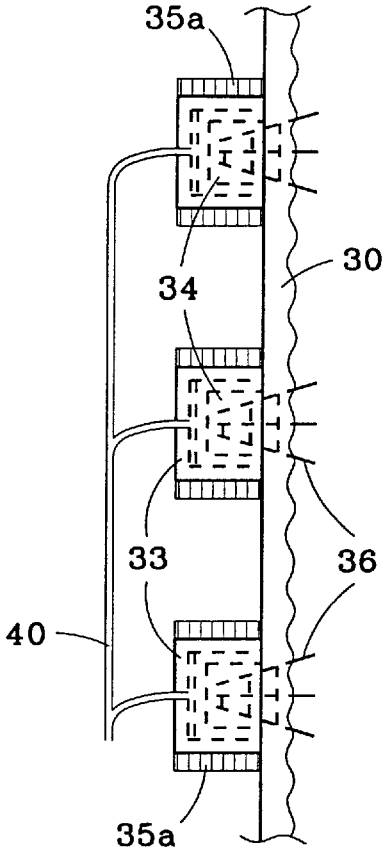

The details of a prestressing apparatus 16*a* are shown in FIGS. 2A and 2B. The apparatus comprises cylinders 33 with annular deformable covers 35*a*, pistons 34 consisting of tubes filled with concrete, fluid 44, ducts 40, a frame board 30, reinforcement 36, bracing bars 38, and filling material 42*a*. The cylinder, piston, and fluid compose a main part of a hydraulic jack. The fluid under high pressure provides expanding force in the apparatus that transfers the force to slabs 14*a* and 14*b*. The deformable covers allow a small lateral relative displacement between slab 14*a* and the cylinders for avoiding some unpredictable stress concentration during the expanding. The filling material is deformable to keep filling up the slab slit whose width varies due to environmental variation and other reasons. Apparatus 16*a* is an independent assembly of many components. Without slabs 14 it can stand on a pavement support base and keeps its right position, as shown in FIGS. 3A and 3B. When the slabs are formed or cast, the apparatus forms a slit between the slabs for the later prestressing.

The installation, construction, and/or operation of prestressing apparatus 16*a* and slabs 14 are as follows.

(1) Make the apparatus (not including filling material 42*a*).

One of the apparatus is shown in FIGS. 3A and 3B. Frame board 30 positions pistons and cylinders, i.e. defines the spacing of the cylinders, etc. Bracing bars 38 assist the apparatus to stand. Reinforcement 36 strengthens the pistons.

(2) Place or install the apparatus on a prepared pavement subbase. Surfaces 32 of the frame boards are greased.

(3) Place and process wet concrete to form the slabs. The rough surfaces of boards 30 combine with the concrete, and reinforcement 36 strengthens the combination, hence boards 30 and pistons 34 become parts of slabs 14*b*. Cylinders 33 with deformable covers 35*a* also combine with the concrete and become parts of slabs 14*a*. Surface 32 of frame board 30, and the internal surfaces of cylinders 33 and pistons 34 form a slit between slabs 14*a* and 14*b*. Ducts 40 are partially embedded in and partially extended outside the slabs.

(4) Cure the concrete slabs.

(5) Connect pumps to the outside ends of ducts 40, and pump fluid into the apparatus to perform hydraulic jack function. So the slits between slabs are expanded, i.e. slabs get compressive prestress.

(6) Insert filling material 42*a* into the expanded slits.

(7) Connect the apparatus and accumulators 28.

The pcp comprising the apparatus has the following advantages:

(A) The pavement favors continuous placement of concrete material with a conventional paver and needs only one-time concrete casting.

(B) The prestressing operation is easy and fast.

(C) The slab prestress or the cylinder pressure is controlled and regulated in the pavement service.

(D) The pavement favors step prestressing, that prevents early cracks of concrete, decreases prestress loss from the concrete creep and shrinkage, and increases the concrete strength.

(E) The pavement allows delayed prestressing, that decreases prestress loss from the concrete creep and shrinkage and increases the concrete strength, too. The delayed prestressing operation may be performed after the traffic opening because the operation does not affect traffic much.

(F) Prestress in the slabs can be measured or calculated easily at any time.

(G) The apparatus are also transverse joints that allow slabs to contract and expand.

(H) The joints can firmly transfers all longitudinal force, shear, and moment from one slab to another, hence the slab integrity is kept at the joints. Therefore the maximum stress at the slab transverse edges is eliminated.

(I) If the pavement has an asphalt surface layer or needs a asphalt overlay later, the asphalt layer will not have reflection cracks and will have transverse contraction cracks at least 60% fewer than its counterpart on a non-prestressed concrete pavement, because no joints or cracks are under the continuous section of the asphalt layer and the concrete slab contracts as the asphalt layer contracts.

(J) The prestress can temporarily be removed, partially or completely, in short section or long section, for rehabilitation or reconstruction.

Figure 4D:
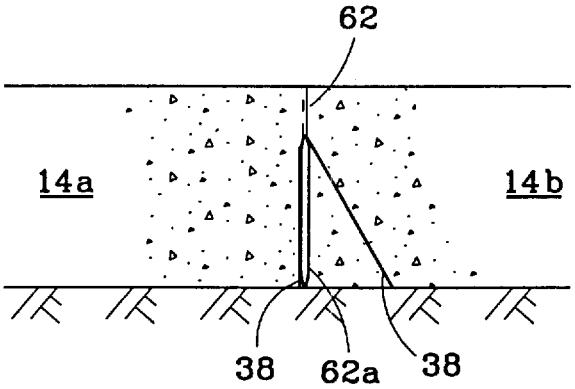
FIGS. 4D is a side view of the prestressing apparatus in FIGS. 4A, 4B and 4C just after the slabs form.
Figure 4A:
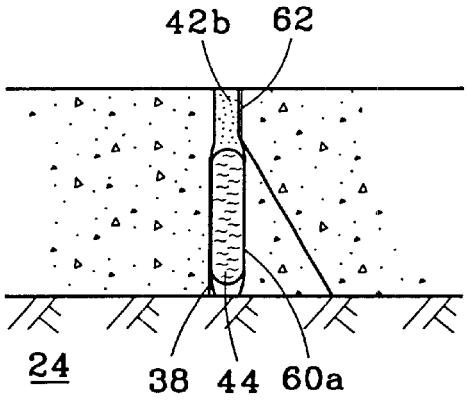
FIGS. 4A,4B, and 4C are two side views and one front view of another prestressing apparatus in a pcp, respectively.
Figure 4B:
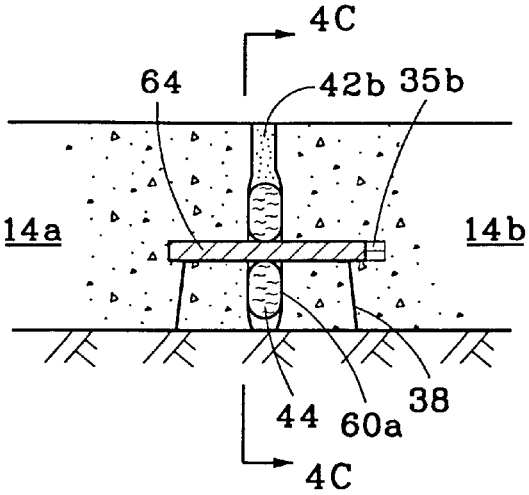
Figure 4C:
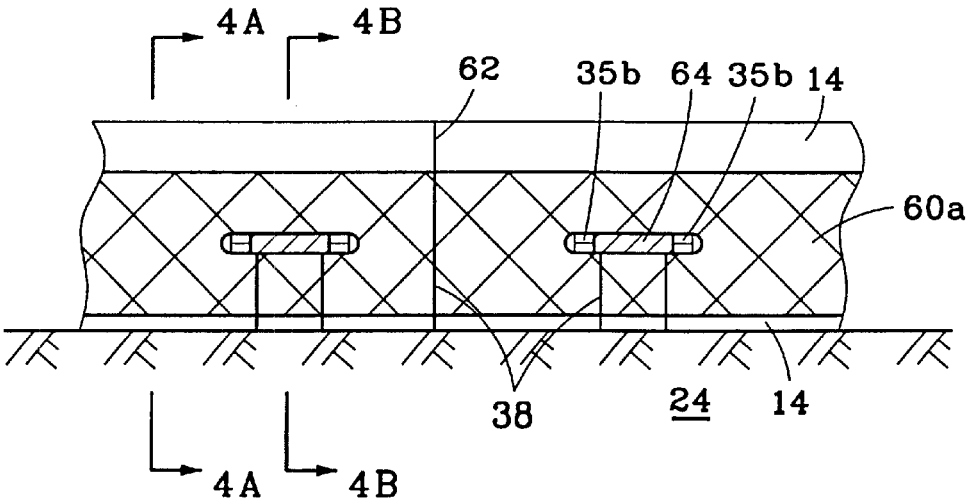

Another prestressing apparatus 16*b* is shown in FIGS. 4A, 4B and 4C. The apparatus comprises a thin, flexible tube 60*a* containing fluid 44, ducts (not shown), dowels 64 with deformable edges 35*b*, a filling strip 42*b*, vertical and slanted bracing bars 38, and indicating sticks 62. The tube is along the pcp transverse direction, and the fluid in the tube under high pressure exerts longitudinal compression to slabs 14*a* and 14*b*. The dowels vertically align slabs 14*a* and 14*b*, but allow a small lateral relative displacement between the slabs for avoiding unpredictable stress concentration.

The installation, construction, and/or operation of apparatus 16*b* and slabs 14 are as follows.

(1) Make the apparatus and install them on a prepared pavement subbase.

(2) Place and process concrete material to form the slabs. Tubes 60*a* form non-through slits between the slabs, as shown in FIG. 4D. The top ends of some or whole indicating sticks 62 are exposed on the slab surfaces.

(3) Cure the concrete and saw it along the lines of the stick ends to make the slits through.

(4) Pump fluid into the flat tubes to compress the slabs.

(5) Fill filling strips 42*b* into the slits.

(6) Connect tubes 60*a* and accumulators 28.

Compared with prestressing apparatus 16*a*, apparatus 16*b* has the following additional advantages.

(A) The tube has a larger contact area with the slabs. So for providing the same slab prestress, the tube pressure is less than the cylinder pressure. A lower pressure in a hydraulic system reduces the system cost.

(B) The tube produces little stress concentration in the slabs.

(C) In concrete casting, the concrete mixture flows over the tubes in part and forms a continuous, even surface.

(D) The flexible tube favors construction of roller compacted concrete pavements.

Figure 5A:
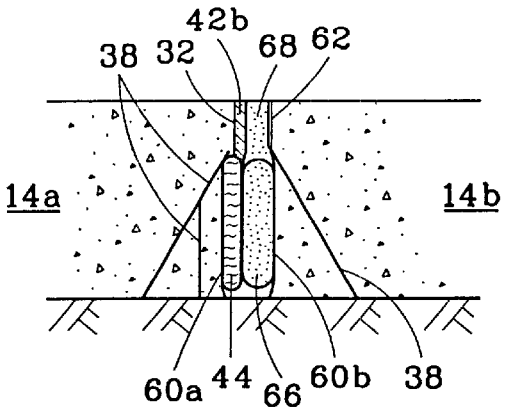
FIG. 5A is a side view of still another prestressing apparatus in a pep.

If a slit is expected to have a large width because of, for example, high rate concrete creep or abutment displacement, another prestressing apparatus 16*c* may be applied which is shown in FIG. 5A. This apparatus comprises thin, flexible tube 60*a*, dowels(not shown), indicating sticks 62, etc. as prestressing apparatus 16*b* does, and additionally comprises thin, flexible tube 60*b* containing pressured grout 66. The grout partially fills in the slit for reducing the joint active width.

The installation, construction, and/or operation of apparatus 16*c* and slabs 14 are as follows.

(1) Make the apparatus and install it on a prepared pavement subbase.

Figure 5B:
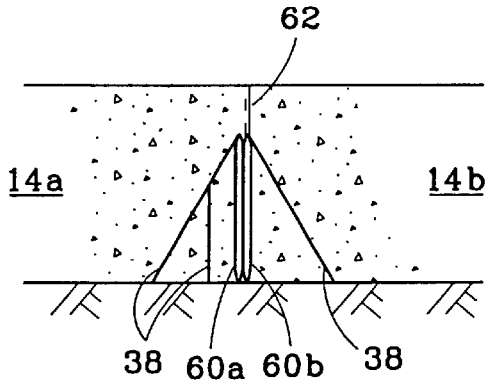
FIG. 5B is the prestressing apparatus in FIG. 5A just after the slabs form.

(2) Place and process concrete material to form the slabs. Tubes 60*a* and 60*b* form a non-through slit between the slabs, and the top ends of some or whole indicating sticks 62 are exposed on the slab surfaces, as shown in FIG. 5B.

(3) Cure the concrete and saw it along the line of the stick ends to make the slit through.

(4) Pump grout into flat tube 62*b* to compress the slabs. The slit gets open.

(5) grease surface 32 in the slit.

Figure 5C:
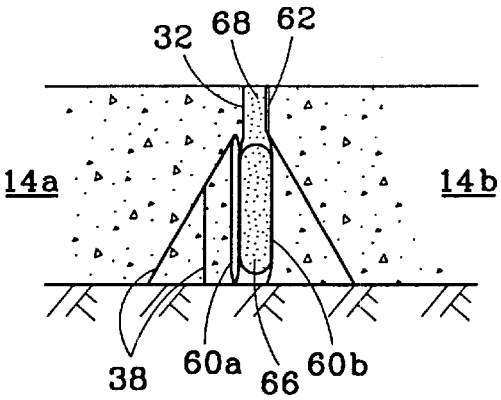
FIG. 5C is the prestressing apparatus in FIG. 5A before fluid is pumped into it.

(6) Fill concrete material in the slit, as shown in FIG. 5C.

(7) Pump fluid 44 into tube 60*a* at a suitable time.

(8) Fill filling strips 42*b* into the reopen slit.

(9) Connect tube 60*a* and accumulator 28.

Prestressing apparatus 16*a*, 16*b*, and 16*c* use fluid or liquid as a prestressing or actuating medium. The main reason is that fluid is permanently able to flow out from or into the apparatus to respond to the slab length variation. If the slab length is expect ed not to change much, for instance, a pavement in a deep tunnel where the temperature does not change much, the fluid may be replaced by other flowable or temporarily flowable materials, e.g. grout.

Abutment

Figure 6A:
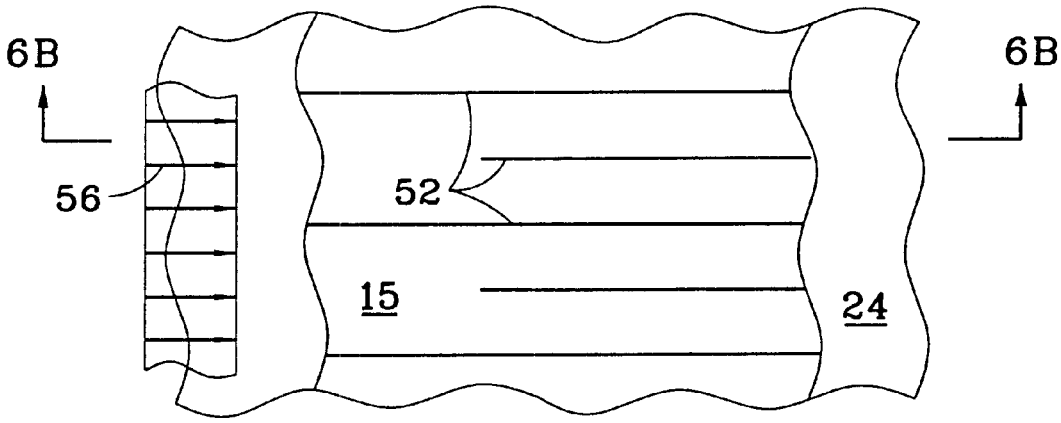
FIGS. 6A and 6B are a plan and a side section of a slab abutment.
Figure 6B:
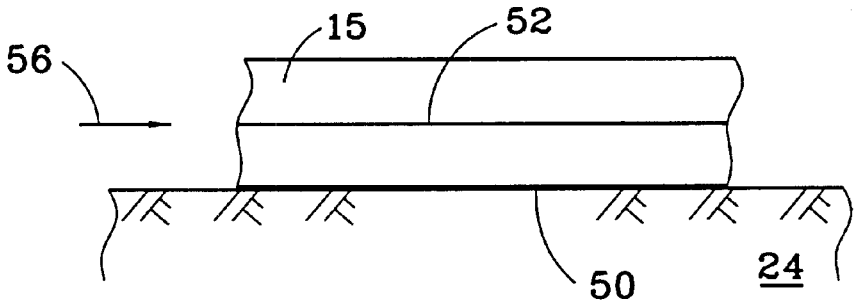

At ends and plane curve sections (i.e. at straightaway ends) of a pcp, abutments are required to resist the force from slab prestress. The details of a slab abutment 22 in FIG. 1 are shown in FIGS. 6A and 6B. The abutment is mainly a reinforced pavement slab 15 bearing traffic loads like other slabs 14 doing. The surface of subbase 24 is specially processed to obtain a high friction interface 50 between slab 15 and the subbase. Because the large friction considerably reduces the prestress, i.e. the strength of the abutment slab, gradually from the slab end to center, reinforcement 52 increases gradually from the slab end to center. The resistance of abutment 22 to prestress load 56 comes from the fiction between reinforced slab 15 and subbase 24.

In addition to the friction another slab abutment uses interlocking rods 54, as shown in FIG. 5C, to produce interlocking force between abutment slab 15 and subbase 24 and thus reduce the slab length. The rods may be combined with the stands supporting and positioning reinforcement 52.

There may be some man-made or natural objects, e.g. buildings, road mediates, traffic-sign posts/frames, bridge piers/abutments, or hills, near, above and/or under the pcp. These structures or objects may be utilized as abutments instead of or partially instead of the special abutments.

Figure 7A:
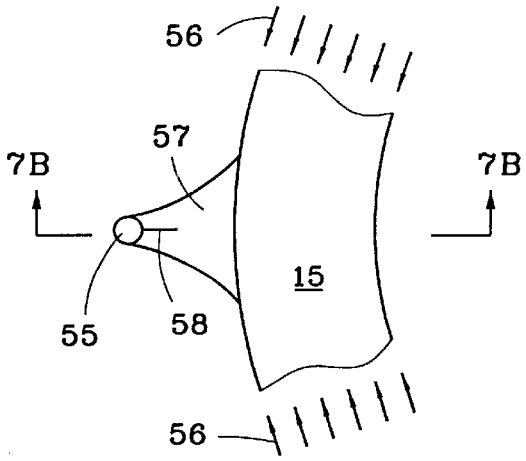
FIGS. 7A and 7B are a plan and a transverse profile of a slab abutment with a post, respectively.
Figure 7B:
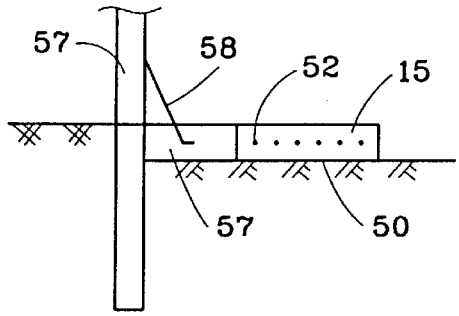

A post 55 utilized as an abutment part is shown in FIGS. 7A and 7B. With a connecting slab 57 and a diagonal brace 58 the post provides a part of resistance to the composite force of prestress load 56. So the length of slab abutment 22 decreases.

Figure 8:
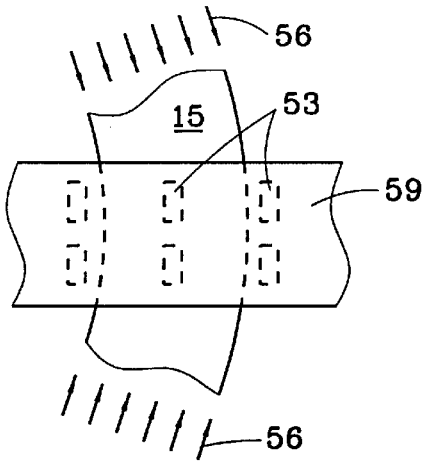
FIG. 8 is a plan of another slab abutment with bridge piers.

In FIG. 8 a road crosses under a bridge 59. The middle two of piers 53 combine with pavement slab 15 to provide resistance to the composite force of prestress load 56. If the middle two piers do not have enough horizontal resistance originally, they may be designed to have extra resistance for the abutment function. And the additional cost is obviously less than a special abutment.

Restraint

Although long thin pavement slabs 14 bear a longitudinal compressive load, the buckling possibility is small because the support base, slab weight, and vacuum pressure restrain the buckling. According to an analysis when the slab thickness is more than 7 inches and the prestress less than 500 psi, the buckling cannot occur on a straight slab no matter how long the slab is. Obviously, the sag curve is safer. Only the crest curve may buckle in some conditions. The buckling can be prevented by restraints joining to the slab and the support base.

Figure 9A:
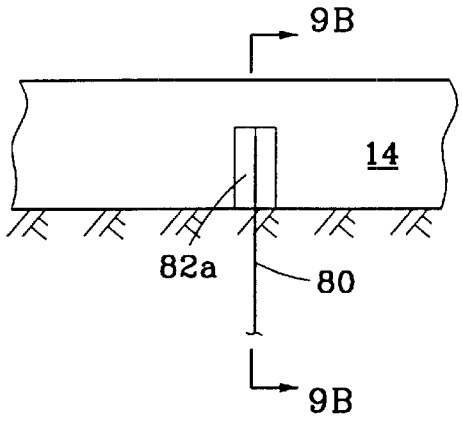
FIGS. 9A and 9B are a side view and a front view of a restraint in a pcp, respectively; and also a longitudinal section and a transverse section of the pcp, respectively.
Figure 9B:
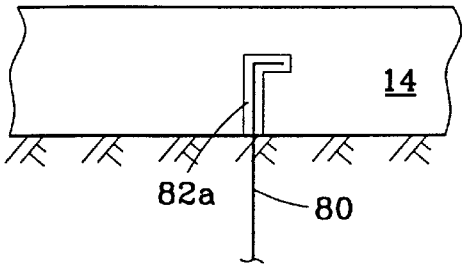

FIGS. 9A and 9B show side views of a restraint 20*a* comprising a steel bar 80 with a bend top and a yieldable component 82*a* covering the upper section of the bar. Since the lower section of bar 80 is fixed in the subbase and subgrade, and the bend hooks slab 14, the restraint restrains the upward deflection of the slab to prevent possible buckling. Because the yieldable component has larger horizontal or plane dimensions than the steel bar, it allows plane the displacement of the slab. But the vertical dimensions of the component is almost the same as the bar upper section, so that the restraint restrains the upward deflection of the slab.

Figure 10A:
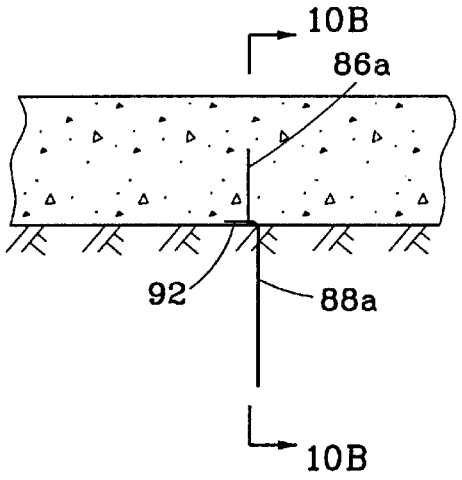
FIGS. 10A and 10B are a side view and a front view of another restraint in a pcp, respectively; and also a longitudinal section and a transverse section of the pcp, respectively.
Figure 10B:
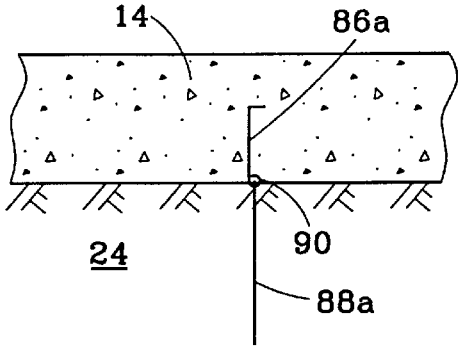

Another restraint 20*b* is shown in FIGS. 10A and 10B. The restraint comprises an upper part 86*a* and a lower part 88*a* that are fixed in the slab and support base, respectively. The surface of support base 24 is not very hard or strong. Connecting the two parts is a sliding pin mechanism, i.e. a pin 92 of the lower part is in pinhole 90 of the upper part and allows the pinhole to slide along the pin. This mechanism allows the relative displacement of the two parts only tangential but not normal to the slab plane. The support base surface also allows the relative displacement because it is not very hard and is yieldable. Therefore, the restraint prevents the slab upward deflection but not the prestress transmission.

Figure 11A:
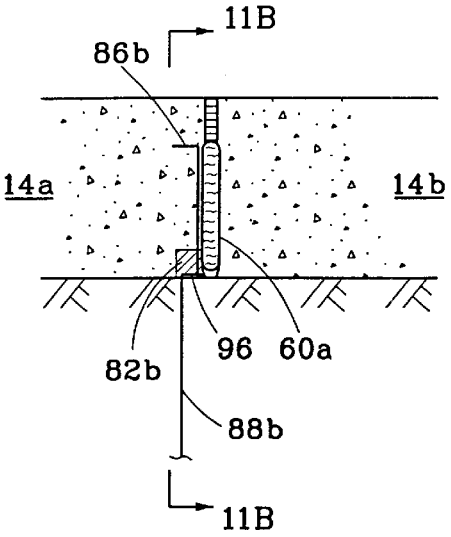
FIGS. 11A and 11B are a side view and a front view of still another restraint in a pcp, respectively; and also a longitudinal section and a transverse section of a pcp, respectively.
Figure 11B:
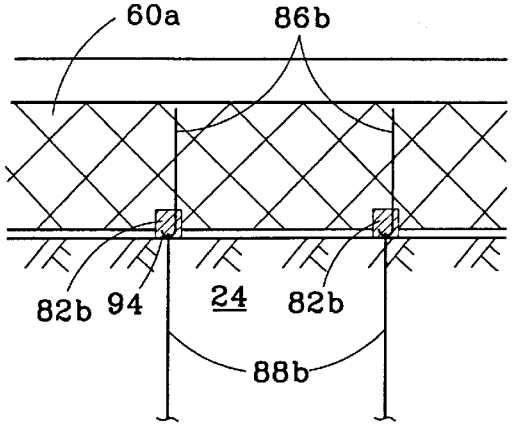

FIGS. 11A and 11B show another restraint 20*c* combined with a prestressing apparatus. The restraint comprises an upper part 86*b* with a hook 94 at its bottom, a lower part 88*b* with a bend 96 at its top, and a yieldable component 82*b* covering hook 94 and bend 96. The upper and lower parts are fixed in slab 14 and support base 24, respectively, and hooked each other by the hook and bend. Component 82*b* occupies a space around hook 94 and bend 96 in the slab. When slab 14*a* gets compression and displacement tangential to its plane, upper part 86*b* moves with the slab and hook 94 compresses yieldable component 82*b* which yields to allow the hook moving, hence the compression can transmit through restraint 20*c*. But the hooking connection of parts 86*b* and 88*b* prevents possible upward deflection of the slab to prevent buckling. In addition to occupying a space in the slab and yielding for allowing the relative displacement of parts 86*b* and 88*b*, component 82*b* lightly fixes upper part 86*b* on lower part 88*b* and/or subbase 24 to position the upper part or make the upper part stand before slab 14 forms. Hook 94, bend 96, and component 82*b* are basically in the slab near the bottom in FIG. 11. But alternatively they may basically be in the subbase near the top, or in both the slab and the subbase.

FIG. 11 also indicates that restraint 20*c* has a function to brace prestressing apparatus in the apparatus installation. All the three kinds of restraints can be either located at a substantial distance from slab edge, as shown in FIGS. 9 and 10, or combined with prestressing apparatus. Yieldable components 82*a* and 82*b* in restraints 20*a* and 20*c* may be made of deformable and/or easily destroyable materials.

Another method to prevent buckling is utilizing atmospheric pressure effectively. FIGS. 11'A and 11'B give an example in which a pavement slab section 14 is on an integral (not granular) subbase 24 having strong cohesion, a thin layer of adhesive, ductile material 96 is in two ring areas between the slab and the subbase, and longitudinally prestressing apparatus are not shown. The ring-shape adhesive ductile material adheres to both slab 14 and subbase 24 and encompasses two circle areas to be insulated from the atmosphere. When the circle areas(including the ring areas) of the slab get upward deflection, vacuum occurs inside the circle areas between the slab and the subbase and atmospheric pressure 98 applies on the slab top surface in the ring and circle areas. The atmospheric pressure is a significant force to resist the upward deflection. Only 10% vacuity induces an atmospheric pressure equal to the weight of a 17-inch concrete slab. The adhesion of material 96, of course, also resists the slab upward deflection.

The adhesive ductile material may be asphalt or resin base. When the slab warps or the subbase is depressed, the material thickness changes with them, keeping adhesion to them. In summer the buckling possibility is high, but the active adhesion of the material is high, too, that tightly insulates the inside circles to prevent buckling. In winter the active adhesion is low that may not tightly insulate the inside circles for vacuum, but the buckling possibility is very low if not impossible.

The construction of the pavement in FIG. 11' is simple. Placing adhesive, ductile material 96 with top cover sheets having rough surface texture, and casting concrete to which the cover sheets join are two key steps.

Accumulator

Figure 12:
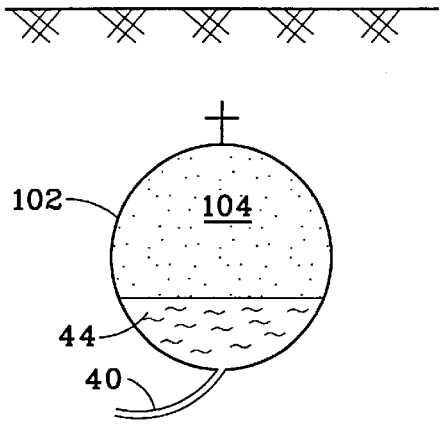
FIG. 12 is a schematic of an accumulator.

Environmental temperature variation makes the pavement slab length change. If the fluid volume in the prestressing apparatus does not change, the slab length change makes the slab prestress vary in a large scale, that will damage the pcp system. In order to control or regulate the slab prestress automatically, hydraulic accumulators are applied. FIG. 12 shows a hydraulic accumulator comprising a steel tank 104 embedded near the pavement, fluid 44 and compressed gas 104 inside the tank, a duct 40 connecting the tank and the prestressing apparatus, and a valve on the tank top. According to a hydraulic theory, the pressures in the prestressing apparatus and in the accumulator are the same if ignoring the fluid weight; the pressure variation in the apparatus causes the fluid to flow between the apparatus and the accumulator, and a new pressure balance between the two devices is reached. The new pressure $P_n$ and new gas volume $V_n$ in the accumulator follow Boyle's law $$P_nV_n = \text{a constant} = P_oV_o, \quad (1)$$

where $P_o$ and $V_o$ are the original pressure and gas volume in the accumulator. $P_n=P_o+dP$, where dP is a predetermined allowable pressure variation. $V_n=V_o+dV$, where dV is a fluid volume differential in the accumulator that can be calculated according to the slab length variation. Therefore $V_o$ in Equation (1) can be solved. $V_o$ plus a maximum positive dV is a theoretical volume of the accumulator. If the original gas volume $V_o$ is sufficiently greater than the fluid volume differential dV in the tank, the new pressure is sufficiently close to the original pressure, i.e. the prestress in the slabs varies in a small range.

If no prestress is desired, the accumulator may still be used for other purposes, for example, providing pressure in the slab joints to respond to the joint-width variation.

Figure 13:
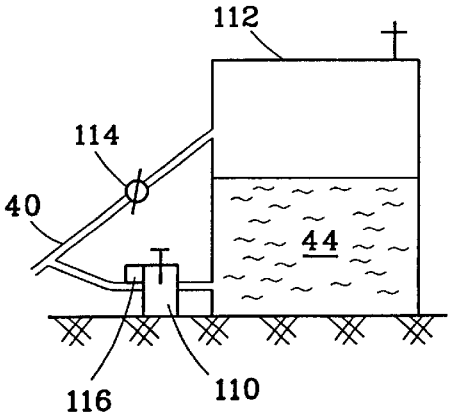
FIG. 13 is a schematic of a pumping station.

The accumulator may be replaced by a pumping station that needs permanent power but can service a longer section of a pcp. FIG. 13 shows a pumping station comprising fluid reservoir 112, pressure-reducing valve 114, a pump 110 with power and a pressure-sensitive automatic switch 116, and ducts 40 communicating with prestressing apparatus. When the pressure in ducts 40 is higher than a predetermined value, the pressure-reducing valve automatically opens for the fluid to flow from the ducts (hence prestressing apparatus) to the reservoir to reduce the high pressure. And when the pressure in the ducts is lower than another predetermined value, the pressure-sensitive switch turns on pump 110 to drive fluid 44 from reservoir 112 to ducts 40 (hence prestressing apparatus) until the pressure in ducts 40 reaches still another predetermined value.

Because the environmental temperature varies gradually and slowly, it is not necessary for the accumulator or pumping station to react quickly, so the fluid in the hydraulic system can have high viscosity and the ducts have small diameter. The high-viscosity fluid and small-diameter ducts reduce the hydraulic system cost, because the system does not require complicated and expensive sealing components, and the ducts do not require high circular tensile strength.

Friction-Reducing Medium

Figure 17:
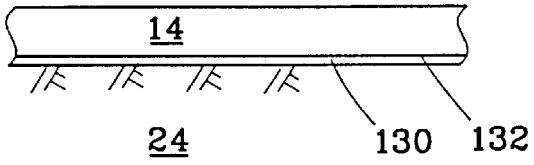
FIG. 17 is a pcp with jelly friction-reducing medium.

The friction between the pavement slabs and the support base may make the long slabs early cracking before the slab concrete gains sufficient strength. The friction also decreases the prestress in the slab areas far from the prestressing apparatus in prestressing. These problems can be solved by placing a friction-reducing medium between the slabs and the support base. The new pcp uses a new friction-reducing medium which comprises a layer of a lubricating jelly 130, as shown in FIG. 17. Between jelly 130 and slabs 14 is a sheet of thin, flexible material 132 that protects the jelly when the concrete is poured. The jelly is water base that is economical. Oil or other base jelly also works well. The thin flexible material may be paper. Under the atmospheric action, the jelly top layer may become a continuous thin tensile layer that can protect the jelly, so that sheet 132 may not be required. If subbase 24 is granular or absorbent of liquid or oil, another layer between the subbase and the jelly is required to protect the jelly. The jelly and layers above and below the jelly do not require long service life and high strength because the lubricating or friction-reducing function is needed only in a short period. Therefore cheap, short-life materials, e.g. water and paper, can be applied. The present friction-reducing medium can reduce the friction coefficient to 0.3 or below that is much less than the friction coefficient in general concrete pavements, 1.5.

Conversion of Non-Prestressed Pavement

The principles in the new pcp may be used to convert existing non-prestressed concrete pavements to pcp.

Figure 18A:
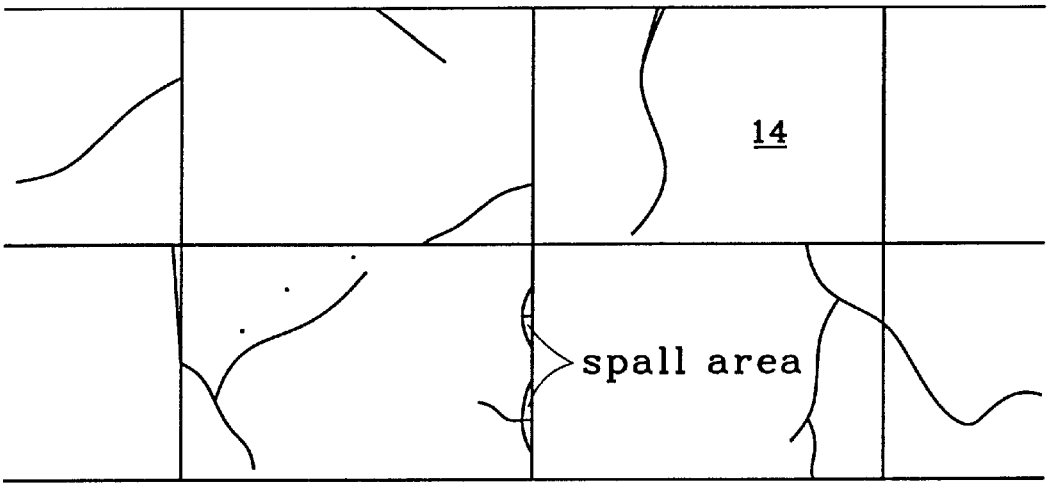
FIGS. 18A and 18B are a plan and a longitudinal profile of a non-prestressed concrete pavement in poor condition, respectively.
Figure 18B:
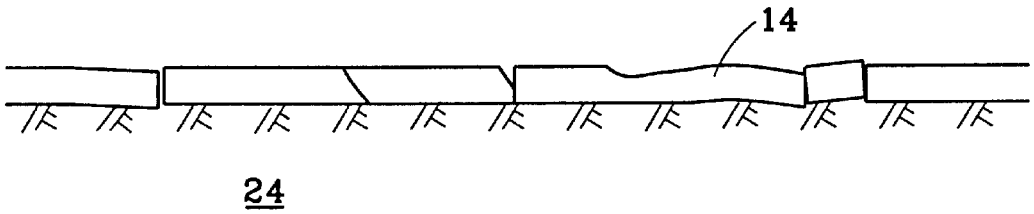

FIGS. 18A and 18B shows a 9-inch plain concrete pavement being in poor condition and needing overlay rehabilitation. According to conventional analysis, the overlay is 6 to 8 inch concrete and reinforcement may be required. But if the pavement is converted to the new pcp, the overlay thickness is at most 4 inches and no reinforcement is required. The reasons are most transverse joints and cracks in the pavement are closed or inactivated and the slab tensile strength is increased.

Figure 19A:
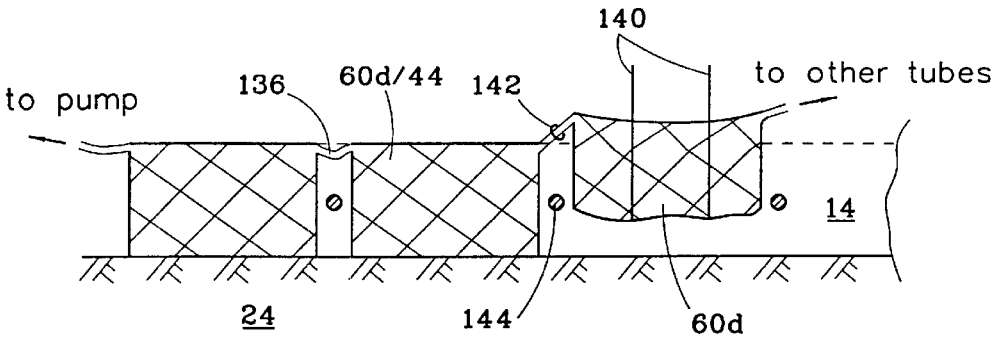
FIGS. 19A and 19B are a transverse section and a plan showing prestressing-tube insertion, respectively.
Figure 19B:
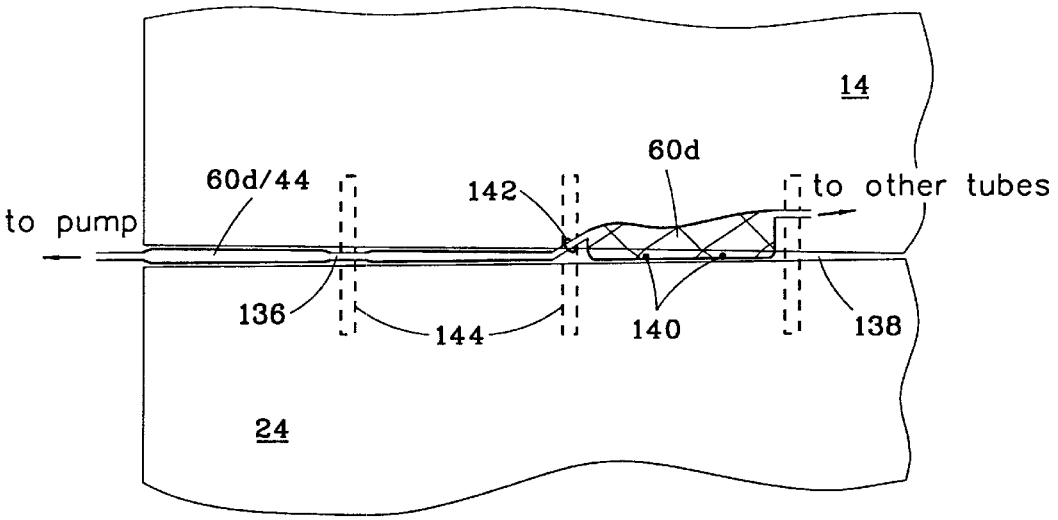

The key in the pavement conversion is placing longitudinally prestressing apparatus(thin, flexible tubes) in position. To achieve this, short tubes connecting as a series are successively inserted into and pressured in an existing joint. The series of tubes is shown in FIGS. 19A and 19B that are an inserting situation. Tube 60*d* is like the forgoing thin flexible tubes, but is much shorter, around one foot, and more flexible. The tubes made of nitrile rubber are connected one by one with hoses 136. The main procedure of the tube placing is as follows.

(1) Select a period when the transverse joint gaps are the widest or so and the friction between the pavement slabs and the support base is the least or so.
(2) Select a wide and smooth transverse joint 138.
(3) Saw or abrade the joint wall(the slab transverse edge) at the joint end to make a short section of the joint gap wide enough to receive the thin tube. Other equipment may also be used to open the gap.
(4) Insert the first tube of the tube series, i.e. the left one in FIGS. 19A and 19B, into the widened joint gap with temporary handlers 140.
(5) Attach a clip 142*a* on the first hose connecting the first and the second tubes, and then pump fluid into the first tube to widen the gap section adjacent to the first tube.
(6) Insert the second tube between dowel bars 144, attach the second clip on the hose connecting the second and the third tubes, remove the first clip, and pump fluid into the first and second tubes.
(7) Similarly repeat step (6) until the joint gap is filled with the tubes in full length.
(8) Release the pressure in the tubes in the joint, move for around 200 to 250 feet to next joint, and repeat steps (2) to (7).

The whole converting procedure of an existing non-prestressed concrete pavement is as follows.

(1) Make longitudinally prestressing apparatus.
(2) Insert the apparatus to some existing joints at 200 to 250 foot spacing, referring to FIG. 20.
(3) Pump fluid into the apparatus to close transverse joint gaps and cracks 148.

(4) Process or treat the existing slab surface to make it bondable to the later overlay.
(5) Place concrete overlay 150.
(6) Saw the overlay along the apparatus tops to make transverse slits, and apply partial prestress on the existing slabs by stages to prevent the early cracking of the overlay.
(7) After the overlay hardens, pump fluid into the prestressing apparatus, i.e. prestress the existing slabs and the overlay.
(8) Fill deformable strips 42*b* into the overlay slits.
(9) Set up hydraulic accumulators and connect them to the apparatus.

Figure 20:
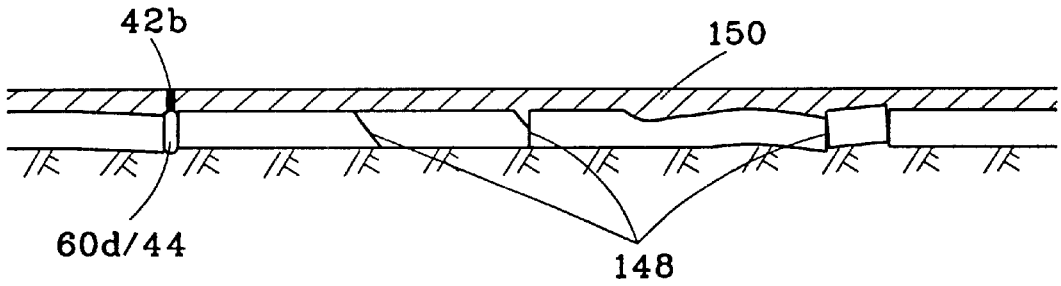
FIG. 20 is a complete overlay on a converted concrete pavement.

The completed rehabilitation is shown in FIG. 20.

The overlay material for the converted pavement is not only Portland cement concrete but also asphalt concrete. The required thickness of the asphalt concrete overlay is also significantly less than that for the non-converted pavement. And as mentioned above, the asphalt overlay will not have reflection cracks and will have fewer transverse contraction cracks.

If an existing non-prestressed pavement needs conversion to prestressed pavement without overlay, step (3) to (6) in the whole converting procedure may be canceled.

I claim:

1. A prestressed pavement comprising:
(a) slabs on a support base,
(b) at least one hydraulic apparatus between said slabs for providing prestress on said slabs, and
(c) means for regulating said prestress, said means communicating with said apparatus and comprising hydraulic means for supplementing said prestress and damping the prestress rise.

2. A prestressed pavement according to claim 1, wherein said apparatus comprises slit-forming means for forming a slit between said slabs and slit-expanding means for expanding said slit for prestressing said slabs, said slit being a non-through slit.

3. A prestressed pavement according to claim 2, wherein said apparatus further comprises indicating sticks, said sticks exposing on the slab surfaces after said slabs form for indicating cutting position.

4. A prestressed pavement according to claim 1, wherein said apparatus comprises at least one thin flexible tube containing hydraulic fluid.

5. A prestressed pavement according to claim 1, further comprising at least one thin flexible tube to be filled with temporarily flowable material for narrowing the gap between said slabs, said tube being substantially parallel to said apparatus.

6. A prestressed pavement according to claim 4 being built by converting a non-prestressed concrete pavement to it.

7. A prestressed pavement according to claim 1, wherein said hydraulic means comprise at least one hydraulic accumulator.

8. A prestressed pavement according to claim 7, wherein said accumulator comprises at least one vessel containing fluid and compressed gas.

9. A prestressed pavement according to claim 7, wherein said accumulator is embedded underground.

10. A prestressed pavement according to claim 1 further comprising a friction-reducing medium between at least one of said slabs and said base, said medium comprising a layer of lubricating jelly, whereby before the slab gains sufficient strength, the slab cracking is prevented.

11. A prestressed pavement according to claim 10, wherein said jelly comprises means for converting its top layer, under atmospheric action, into a thin flexible tensile layer to protect said jelly during making the slab.

12. A prestressed pavement according to claim 10, wherein said medium further comprises a layer of thin flexible material between said jelly and the slab for protecting said jelly during making the slab.

13. A prestressed pavement according to claim 10, wherein the jelly base material is at least one of water and oil.

14. A prestressed pavement according to claim 10, wherein said jelly has means for disabling itself from lubricating function after said pavement is built.

15. A prestressed pavement according to claim 1 further comprising a layer of adhesive material in at least one area between at least one of said slabs and said base, said material adhering to the slab and said base, whereby when the slab area gets upward deflection, vacuum occurs in said area for preventing the slab buckling.

16. A prestressed pavement according to claim 15, wherein said area encompasses another area not having said material.

17. A prestressed pavement according to claim 15, wherein said material is ductile.

18. A prestressed pavement according to claim 15, wherein said material is one of asphalt-base material and resin-base material.

19. A prestressed pavement comprising:
(a) slabs on a support base; and
(b) at least one restraint, said restraint comprising
an upper part locked to one of said slabs,
a lower part fixed in said base,
a connection connecting the two parts, said connection allowing relative displacement of said two parts tangential but not normal to the slab plane, and
a yieldable component covering partially or entirely said connection and occupying a space in one of the slab and said base for allowing the relative displacement tangential to the slab plane,
whereby said restraint resists upward deflection of the slab for preventing buckling, but allows plane displacement of the slab for prestress transmission.

20. A prestressed pavement according to claim 19, wherein said yieldable component comprises means for lightly fixing said upper part on at least one of said lower part and said base before the slab forms.

21. A prestressed pavement comprising
(a) at least one slab on a support base, said slab bearing prestress; and
(b) at least one restraint connecting said slab and said base, said restraint comprising:
(i) a firm component having an upper part locked in said slab and a lower part fixed in said base, and
(ii) a yieldable component covering said upper part in said slab, the vertical dimensions of said component being the same or almost same as those of said upper part, but the horizontal or plane dimensions of said component being larger than those of said upper part;
whereby said restraint restrains upward or possible upward deflection of said slab for preventing buckling, but allows plane displacement of said slab for avoiding obstructing prestress transmission.

22. A prestressed pavement comprising:
(a) slabs on a support base,
(b) at least one hydraulic apparatus between said slabs for providing prestress on said slabs,
(c) means for regulating said prestress, said means communicating with said apparatus and comprising hydraulic fluid and a pumping station, said pumping station comprising
at least one pump and power supply,
at least one fluid reservoir, and
at least one pressure-releasing valve.

23. A prestressed pavement according to claim 22, wherein said pumping station further comprises a pressure-sensitive automatic switch for switching said pump on and off.

24. A method for converting a non-prestressed concrete pavement to a prestressed pavement comprising the steps of (a) making thin, flexible tubes;

(b) inserting said tubes into some transverse joints between some slabs of said non-prestressed concrete pavement at predetermined spacing range;

(c) pumping at least one kind of flowable material into the inserted tubes to prestress the slabs of said non-prestressed concrete pavement; and (d) connecting the pressured tubes to hydraulic means for supplementing the prestress and damping the prestress rise.

25. A method according to claim 24, wherein said step (b) comprises the steps of i widening a short section of a gap at one of said joints;

ii inserting at least one of said tubes into the widened section;

iii pumping fluid into the inserted tube to widen a section of said gap near the inserted tube;

iv repeating steps ii and iii until the number of said inserted tubes is enough for prestressing;

v releasing the pressure in the pressured tubes; and vi moving a predetermined distance range and repeating steps i to v.

26. A method according to claim 24 further comprising, between steps (b) and (c), steps of:

(1) pumping at least one kind of flowable material into the inserted tubes to close the transverse joints and the possible cracks in said non-prestressed concrete pavement, (2) processing or treating the slab surfaces to make them bondable to a later overlay, and (3) placing and processing the overlay material; and wherein the prestressed objects in step (c) comprise additionally said overlay.

* * * * *

UNITED STATES PATENT AND TRADEMARK OFFICE

CERTIFICATE OF CORRECTION

PATENT NO. : 6,409,423 B1
DATED : June 25, 2002
INVENTOR(S) : Ran Li

It is certified that error appears in the above-identified patent and that said Letters Patent is hereby corrected as shown below:

Column 10,
Line 49, change "142*a*" to -- 142 --.

Signed and Sealed this

Fifth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,409,423 B1
DATED : June 25, 2002
INVENTOR(S) : Ran Li

It is certified that error appears in the above-identified patent and that said Letters Patent is hereby corrected as shown below:

Title page,
Item [76], Inventor, change "Ran Li, c/o Yaxin Li, 710 Fontana PL., Mundelein, IL (US) 60060" to -- Ran Li, 8280 Golf Green Circle, Houston, TX (US) 77036 --.

Column 1,
Line 7, change "3, 1995" to -- 18, 1995 --.

Column 2,
Line 61, after "and" add -- for --.

Column 3,
Line 57, change "pep" to -- pcp --.

Figure 6C:
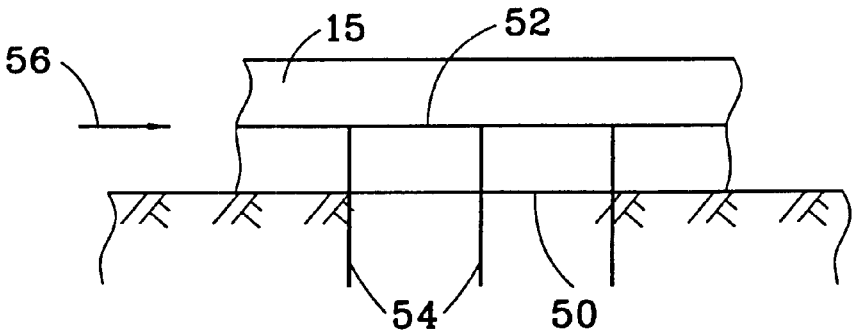
FIG. 6C is a side section of another slab abutment.

Column 6,
Line 47, change "62*b*" to -- 60*b* --.
Column 7,
Line 11, change "FIG. 5C" to -- FIG. 6C --.
Line 16, change "mediates" to -- medians --.
Line 17, after "hills", delete ",".
Line 51, delete the last "the".

Column 9,
Line 4, change "104" to -- 102 --.

UNITED STATES PATENT AND TRADEMARK OFFICE

CERTIFICATE OF CORRECTION

PATENT NO. : 6,409,423 B1
DATED : June 25, 2002
INVENTOR(S) : Ran Li

It is certified that error appears in the above-identified patent and that said Letters Patent is hereby corrected as shown below:

Column 10,
Line 49, change "142*a*" to -- 142 --.

This certificate supersedes Certificate of Correction issued November 5, 2002.

Signed and Sealed this

Twenty-second Day of April, 2002

*Attest:*

*Attesting Officer*

JAMES E. ROGAN
*Director of the United States Patent and Trademark Office*